US010575619B2

(12) United States Patent
Eberlein et al.

(10) Patent No.: US 10,575,619 B2
(45) Date of Patent: Mar. 3, 2020

(54) COSMETIC CONTAINER WITH CLOSURE

(71) Applicant: HCT GROUP HOLDINGS LIMITED, Central (HK)

(72) Inventors: David Jeffrey Eberlein, Los Angeles, CA (US); Megan Rene Langdon, Los Angeles, CA (US); Stephen Charles Burditt, Los Angeles, CA (US)

(73) Assignee: HCT GROUP HOLDINGS LIMITED, Hong Kong (HK)

( * ) Notice: Subject to any disclaimer, the term of this patent is extended or adjusted under 35 U.S.C. 154(b) by 514 days.

(21) Appl. No.: 15/454,625

(22) Filed: Mar. 9, 2017

(65) Prior Publication Data

US 2017/0265618 A1 Sep. 21, 2017

Related U.S. Application Data

(60) Provisional application No. 62/309,021, filed on Mar. 16, 2016.

(51) Int. Cl.

| | |
|---|---|
| ***A45D 34/04*** | (2006.01) |
| ***B65D 51/32*** | (2006.01) |
| ***A45D 34/00*** | (2006.01) |

(52) U.S. Cl.

CPC ..... *A45D 34/045* (2013.01); *A45D 34/00* (2013.01); *B65D 51/32* (2013.01); *A45D 34/046* (2013.01); *B65D 2313/04* (2013.01)

(58) Field of Classification Search

CPC ..... B65D 25/10; B65D 25/02; B65D 41/04; A45D 34/041; A45D 34/042; A45D 33/006

USPC ..... 220/815, 812, 811, 293, 288, 230, 528, 220/254.8, 259.3, 259.4, 212; 206/581, 206/223; 215/329, 316, 335; 132/317, 132/318

See application file for complete search history.

(56) References Cited

U.S. PATENT DOCUMENTS

| | | | |
|---|---|---|---|
| 4,261,485 | A | 4/1981 | Borg |
| 6,382,450 | B1 | 5/2002 | De Rosa et al. |
| 8,944,712 | B2 | 2/2015 | Thorpe |
| 9,138,044 | B2 | 9/2015 | Lim et al. |
| 2003/0089733 | A1 | 5/2003 | Cain et al. |
| 2007/0204872 | A1 | 9/2007 | Kee |
| 2011/0132907 | A1 | 6/2011 | Hajichristou et al. |
| 2012/0279876 | A1 | 11/2012 | Weigel |
| 2014/0102584 | A1 | 4/2014 | Lasnier et al. |
| 2014/0301764 | A1 | 10/2014 | Eberlein et al. |

FOREIGN PATENT DOCUMENTS

| | | | |
|---|---|---|---|
| DE | 01190349 | B | 4/1965 |
| EP | 2719466 | B1 | 8/2015 |
| FR | 1046488 | A | 12/1953 |

(Continued)

OTHER PUBLICATIONS

Extended European Search Report dated Jan. 17, 2020 for EP-Patent Application No. 17 76 7188.0.

*Primary Examiner* — Robert J Hicks

(74) *Attorney, Agent, or Firm* — Seager, Tufte & Wickhem LLP

(57) ABSTRACT

A container assembly having a cap with a channel and a base with protrusions on a collar. The protrusions are received in the channel and guide the cap in a rotating motion onto the base. The cap and base may have magnets that provide an attractive force that brings the cap and base together. The container in cosmetics applications is also discussed.

20 Claims, 8 Drawing Sheets

(56) References Cited

FOREIGN PATENT DOCUMENTS

| | | | |
|---|---|---|---|
| FR | 2973005 | A1 | 9/2012 |
| FR | 2986783 | B1 | 3/2014 |
| FR | 3015441 | B1 | 6/2016 |
| WO | 2014044710 | A1 | 3/2014 |
| WO | 2014114885 | A1 | 7/2014 |

COSMETIC CONTAINER WITH CLOSURE

CROSS REFERENCE TO RELATED APPLICATIONS

The present application claims the benefit of and priority to U.S. Provisional Patent Application Ser. No. 62/309,021, filed on Mar. 16, 2016, titled COSMETIC CONTAINER WITH CLOSURE, the disclosure of which is incorporated herein by reference.

FIELD

The present application relates to the field of product dispensers. Particularly, the present application relates to cosmetics containers with caps, more particularly to cosmetics containers with an applicator.

BACKGROUND

Devices exist for applying cosmetic or medicinal products. Such devices usually consist of an outer tubular shell or bottle for holding a product, a cap for closing the bottle and containing the product, and an applicator, often attached to the cap. In the cosmetics and personal care industries, applicators are used to apply lipstick, lip gloss, lip balm, skin creams, lotions, foundation, concealer, mascara, eye liner, and other cosmetic products to portions of the body. In addition, various cosmetics implements, such as, for example, foundation and lip-gloss applicators exist. These implements typically consist of a handle or cap with a stem and applicator tip that protrudes into a bottle of product. Liquid, gel, and cream products may evaporate or become dry if the cap is not connected tightly, resulting in alteration of the product and potentially wasting product. For caps that screw onto a bottle or container, it may be difficult for the user to know when the cap is secured. Accordingly, there remains a need in the art for improved cap securing mechanisms.

SUMMARY

In an illustrative example, a container is provided comprising a base assembly including a reservoir for holding a product, and a collar with an opening extending therethrough attached to the reservoir, the collar including a first magnet and at least one protrusion on an outer surface of the collar. The container includes a cap assembly that is removably coupled to the base assembly, the cap assembly including a cap and a second magnet, wherein the cap includes at least one angled channel disposed along an inner surface thereof, the channel configured to receive the protrusion in sliding engagement. When the cap assembly is placed over the base assembly with the protrusion positioned in the channel, an attractive force between the first and second magnets pulls the cap assembly onto the base assembly, rotating the cap assembly into a secured position on the base assembly. In some examples, the cap includes an outer cap and an inner cap, wherein the at least one angled channel is disposed along an inner surface of the inner cap.

In another illustrative example, a container is provided comprising a base assembly including a reservoir for holding a product, a collar with an opening extending therethrough attached to the reservoir, and at least one protrusion on an outer surface of the collar. The container includes a cap that is removably coupled to the base assembly, the cap including at least one angled channel disposed along an inner surface thereof, the channel configured to receive the protrusion in sliding engagement, the channel extending less than 360 degrees around the inner surface of the cap, the channel having a main portion, wherein an angle of the main portion relative to a transverse plane extending perpendicular to a longitudinal axis of the container, is between 20 and 60 degrees. When the cap is placed over the base assembly with the protrusion positioned in the channel, the protrusion travels along the channel, guiding and rotating the cap into a secured position on the base assembly.

In a further illustrative example, a self-closing container is provided comprising a base assembly including a reservoir for holding a product, and a collar with an opening extending therethrough attached to the reservoir, the collar including a first magnet and at least one protrusion on an outer surface of the collar. The container includes a cap assembly that is removably coupled to the base assembly, the cap assembly including a cap and a second magnet, wherein the cap includes at least one angled channel disposed along an inner surface thereof, the channel configured to receive the protrusion in sliding engagement, wherein each channel has a main portion and a proximal portion, wherein an angle of the main portion relative to a transverse plane extending perpendicular to a longitudinal axis of the container, is greater than an angle of the proximal portion. When the cap assembly is placed over the base assembly with the protrusion positioned in the channel, the protrusion travels along the channel from the main portion to the proximal portion, thereby rotating the cap assembly as an attractive force between the first and second magnets pulls the cap assembly into a secured position on the base assembly.

BRIEF DESCRIPTION OF THE DRAWINGS

In the drawings, which are not necessarily drawn to scale, like numerals may describe similar components in different views. The drawings illustrate generally, by way of example, but not by way of limitation, various embodiments discussed in the present document.

DETAILED DESCRIPTION

Figure 1A:
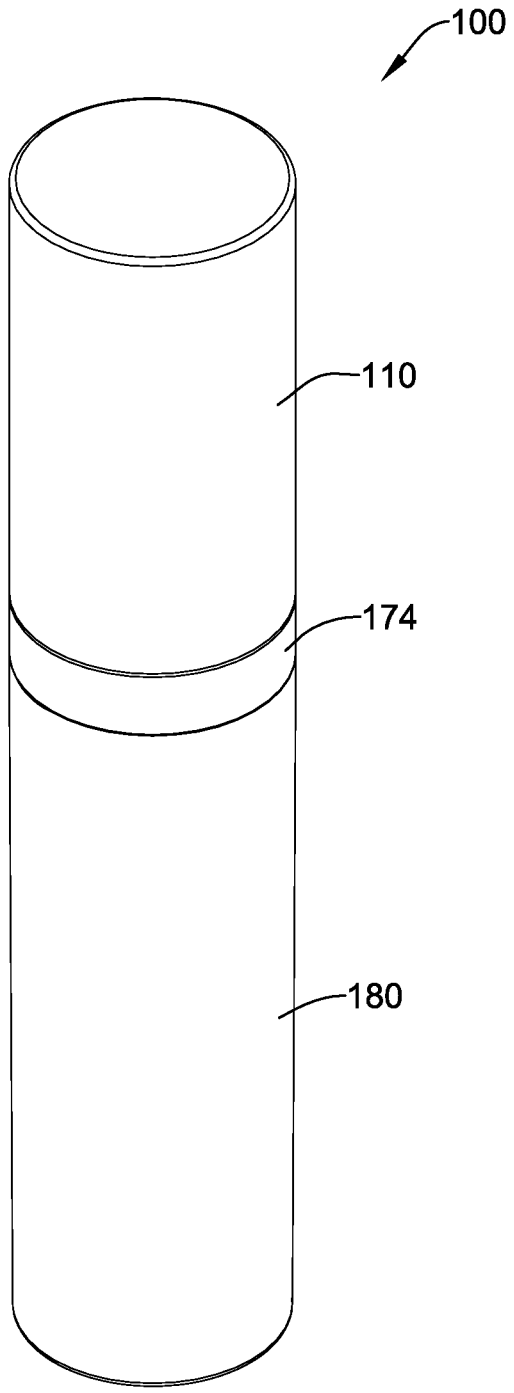
FIG. 1A is a perspective view of an illustrative container.

In the following descriptions of the figures, the term proximal is used in reference to the upper portion of elements as they are shown in the drawings and the term distal is used in reference to the lower portion of elements as they are shown in the drawings. FIG. 1A is a perspective view of an illustrative container. The container may contain cosmetic products.

Cosmetic products that the present invention may be used for may include, without limitation, mascara, lip gloss, eye liner, concealer, eye primer, lash primer, lip stain, nail polish, polish remover, and other products applied via brushes, sponges, or other cosmetic applicators.

Figure 1B:
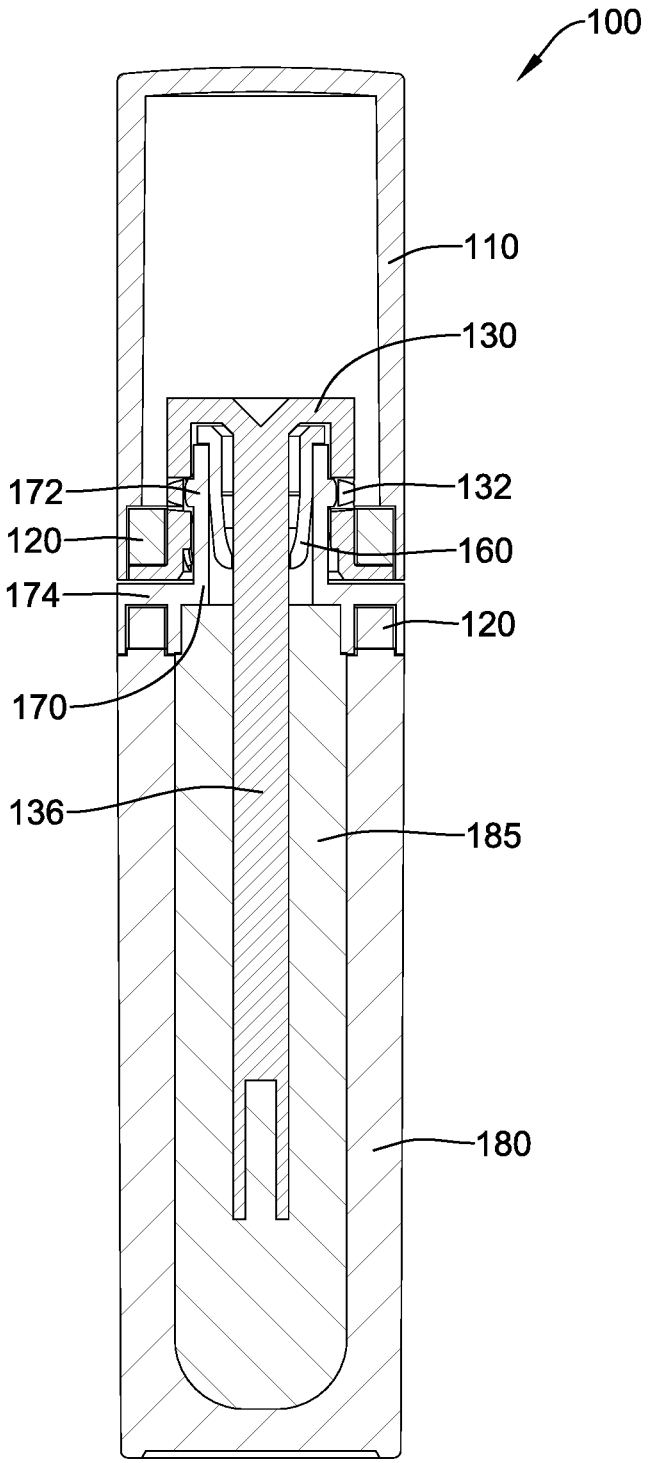
FIG. 1B is a cross sectional view of the container of FIG. 1A
Figure 2:
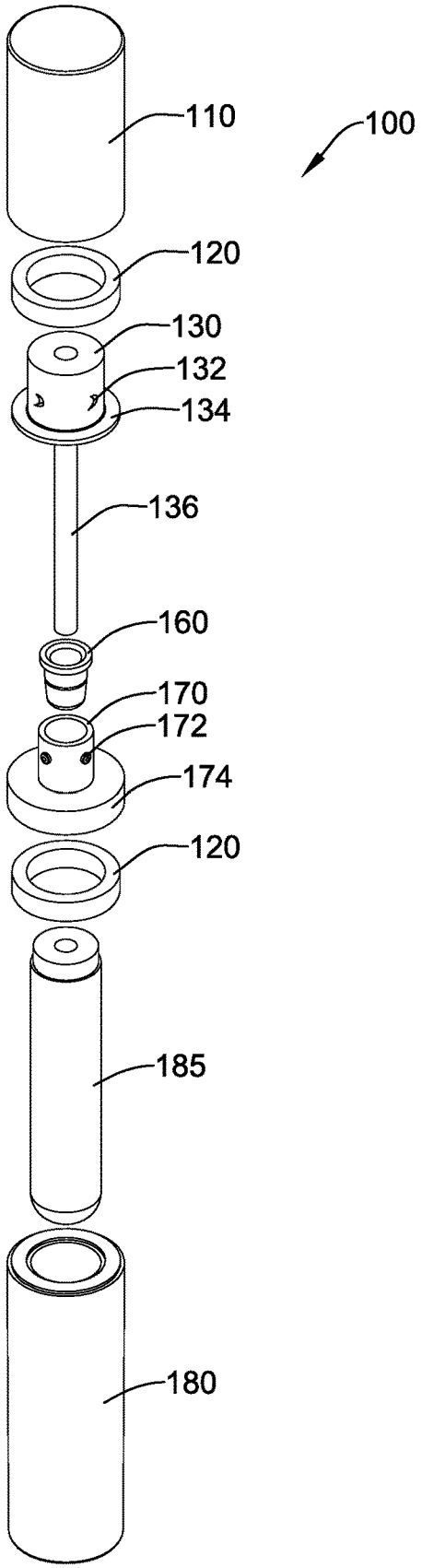
FIG. 2 is an exploded view of the container of FIG. 1A.
Figure 3A:
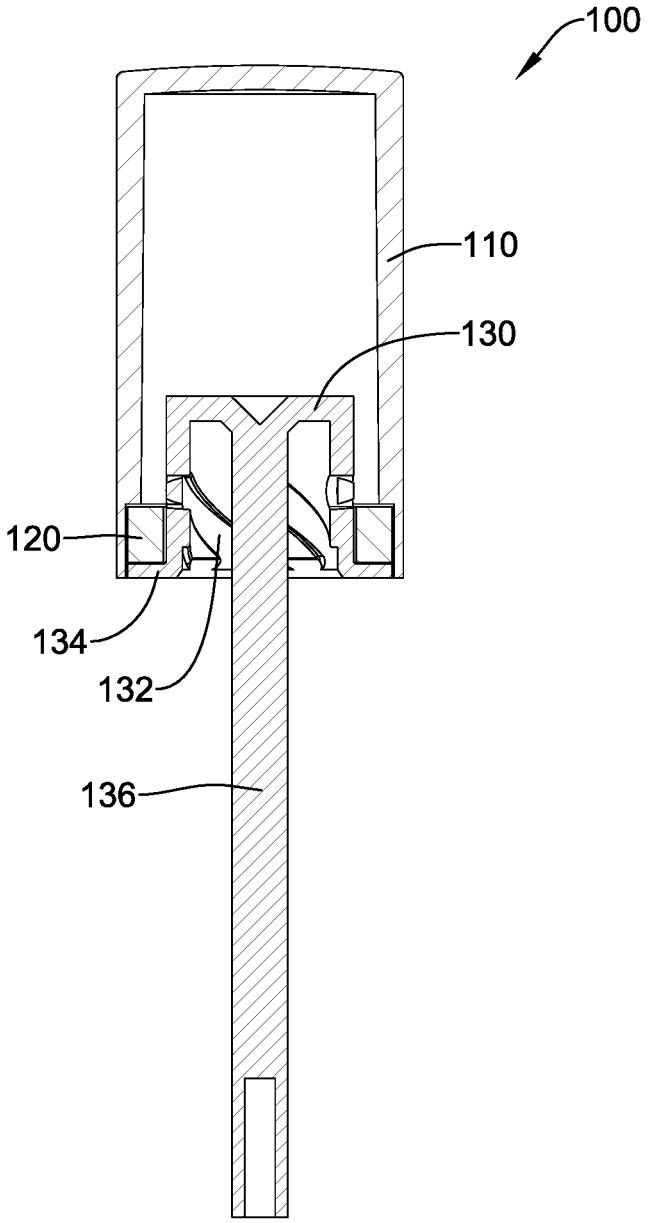
FIG. 3A is a cross sectional view of the cap elements of FIG. 1B.

The parts of the container 100 that are visible when the container is closed include a cap 110, a portion 174 of a collar, and bottle 180. All of the individual elements of the container 100 are shown in FIGS. 1B and 2. The cap assembly as shown in FIG. 3A includes a cap 110, at least one magnet 120, an inner cap or stem 130, and an elongate member 136. An applicator (not shown) designed for the type of product to be used with the container may be inserted into an opening at the distal end of the elongate member 136.

Figure 3B:
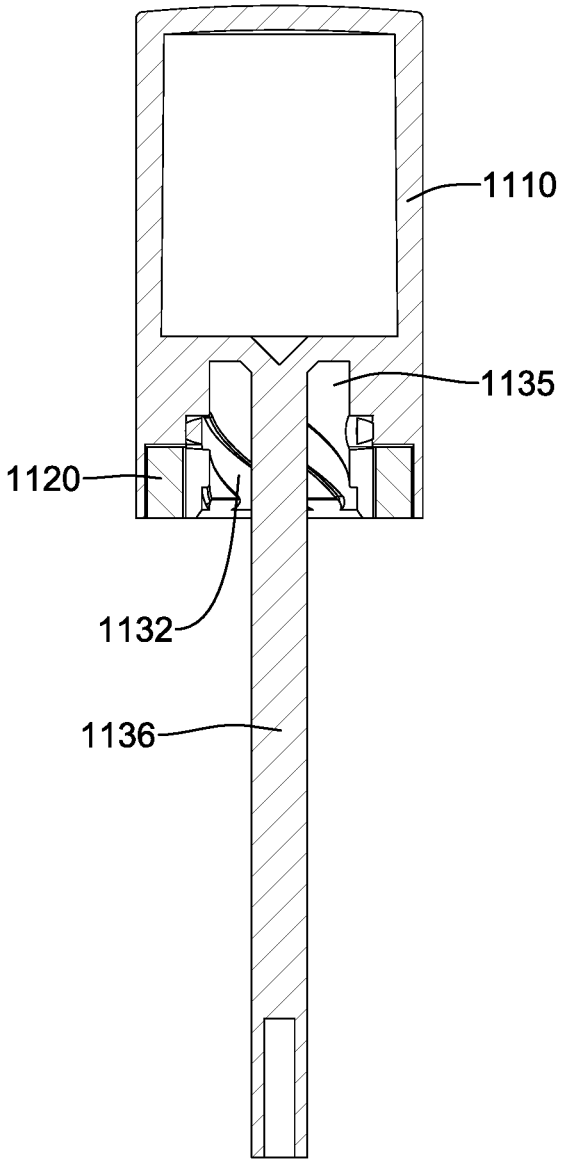
FIG. 3B is a cross sectional view of another cap structure.

The cap assembly may alternatively be a two part assembly as shown in FIG. 3B. In such an assembly, the cap 1110 may have an elongate member 1136 extending downward through an inner cavity 1135 of the cap 1110. The magnet 1120 may be disposed near the distal end of the cap. In another example, the magnet may be disposed above the channels (not shown). In a further example, the magnet may be disposed near the distal end of the cap, with notches in the magnet aligned with the channels (not shown). In a further example, a cap with channels on an inner surface thereof may have magnets disposed at the base of the cap, between the channels. The magnets may be disposed in recesses in the inner wall of the cap (not shown).

The cap assembly may comprise additional parts (not shown) including, but not limited to, internal sealing components, application structures, external gripping elements, and decorative elements. The additional parts may be disposed on the outside and/or inside of the cap.

The base assembly includes a tube or bottle 180 with a reservoir 185 to hold the product. In some examples, the bottle 180 may have a liner (not shown). The base assembly also includes at least one magnet 120, a collar 170 and optionally a wiper 160. As seen in FIGS. 1B and 3, the magnet 120 and stem 130 fit inside the distal end of the cap 110. The magnet and stem may be secured to the cap by an interference fit, with adhesive, or have a snap fit. Alternatively, the stem may be attached to the cap directly via mating features not shown (i.e., a protrusion from the proximal end of the stem all the way to the inside top of the cap). In such a case, the stem and cap may be secured via adhesive, interference fit, snap fit, ultrasonic welding, etc. The magnet 120 may be one or more rings of magnetic material. For example, the magnet 120 within the cap may include a stack of 3 or 4 magnetic rings. The rings are sized and shaped so that when the cap is assembled, the magnetic rings 120 fit over the stem 130 and rest on a stem extension 134 that extends radially outward at the base of the stem. The cap 110 may have a cut-out region to accommodate the magnet 120.

Figure 6:
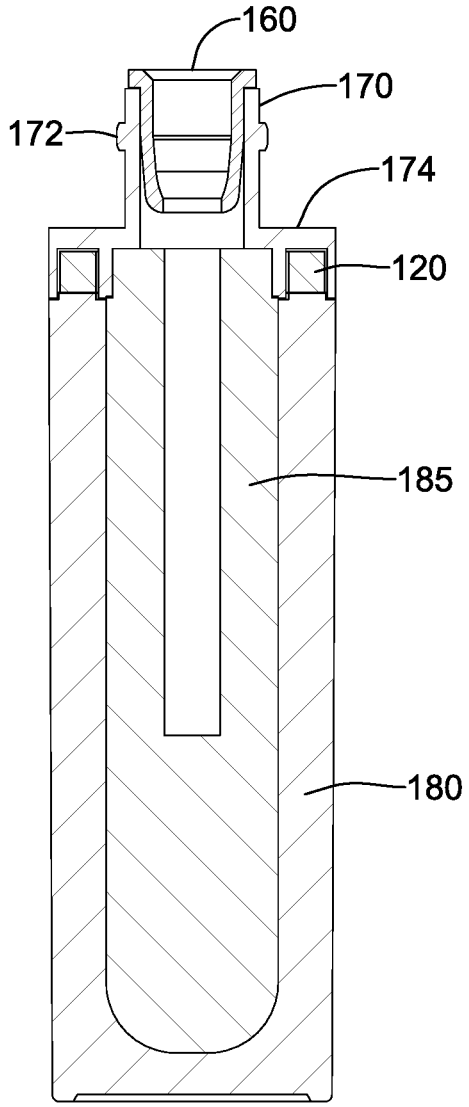
FIG. 6 is a cross sectional view of the container elements of FIG. 1B.

The base portion of the container 100, as shown in FIGS. 1B and 6, is an assembly including the bottle 180 with a reservoir 185 that contains the product, the collar 170, and a magnet 120. The bottle 180 may have a liner (not shown) within the reservoir 185 to hold the product. The magnet 120 is disposed at the proximal end of the bottle 180. As with the magnet contained within the cap, the magnet 120 on the bottle 180 may include one or more magnetic rings. The collar 170 is disposed over the magnet 120 and bottle 180. The collar 170 has a laterally extending lip 174 that engages the bottle 180 and reservoir 185. The collar 170 may include a recess in the lip 174 that receives the magnet 120. The collar 170 and magnet 120 may be secured to the bottle 180 by an interference fit, with adhesive, sonic welding, have a snap fit, or any other appropriate means. The outer surface of the collar 170 near the proximal end includes one or more protrusion 172 that engage a channel 132 in the stem 130, as will be discussed below. A wiper 160 is disposed within an open channel of the collar 170. The wiper serves to wipe excess product from the applicator and elongate member 136. The wiper 160 may have an upper lip for securing it over the open channel of the collar 170. The wiper 160 may be secured to the collar 170 by an interference fit, with adhesive, or have a snap fit.

Figure 4:
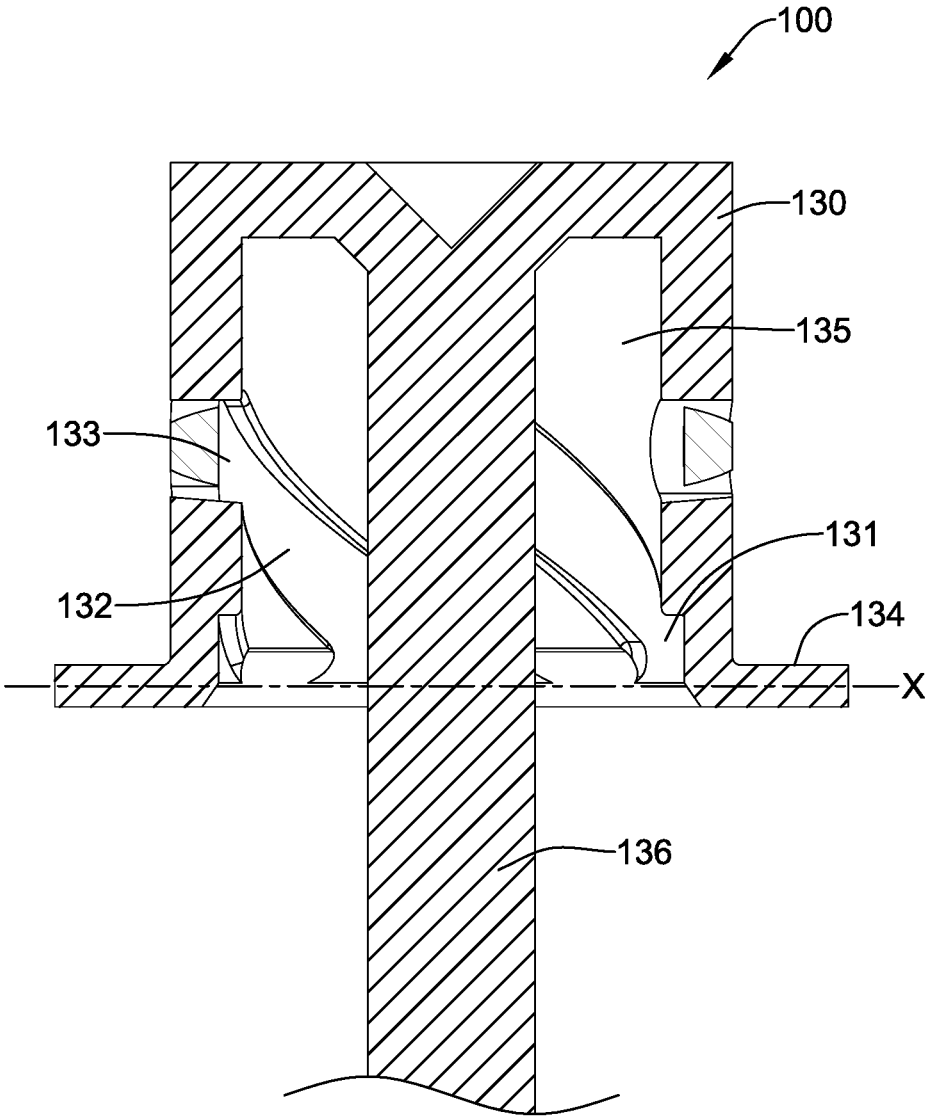
FIG. 4 is a cross sectional view of an internal component of a cap.

FIG. 4 illustrates details of the inner surface of the stem 130. The stem 130 has an open bottom and an inner cavity 135 that receives the collar 170 and wiper 160. An elongate member 136 extends through the cavity 135 from a proximal end of the stem 130. The distal end of the elongate member 136 may include an applicator tip designed for a particular product. For example, a doe foot applicator tip (not shown) may be used with lip gloss, a sponge applicator tip (not shown) may be used with concealer, or various brush type applicator tips (not shown) may be used with mascara, eye liner, or nail polish.

One or more track, groove, or channel 132 extends along the inner surface of the stem 130. The channel 132 is sized and shaped to receive the protrusion 172 on the outer wall of the collar 170. Each protrusion 172 is a discrete structure extending laterally from the outer wall of the collar. The protrusion 172 may have any shape that fits into the channel 132. For example, the protrusion 172 may be a rounded bump, nub, sphere, or cylinder. In other examples, the protrusion may have a decorative shape such as a square, diamond, star, half moon, or product logo shape. A single channel 132 and protrusion 172 would provide for the cap 110 being applied to the bottle 180 in a single orientation. A single orientation cap and bottle connection may allow for a design element to extend along both the cap and bottle and always be in correct alignment. Two opposing channels 132 and protrusions 172 provide for the cap 110 to be placed onto the bottle in two orientations, 180 degrees apart. In the example illustrated in the figures, four evenly spaced apart channels 132 are present in the stem 130 with four corresponding protrusions 172 on the collar 170.

The channels 132 extend from a distal end 131 to a proximal portion 133. The distal end 131 of the channel 132 extends to the bottom opening of the stem to allow the protrusion 172 to enter the channel 132 as the cap and stem 130 are seated over the collar 170. The protrusion 172 travels along the channel 132 as the cap and stem 130 are lowered, causing the cap to rotate. The channels 132 extend at a steep angle relative to a transverse plane X of the container. For example, the main portion 137 of the channels 132 may extend at an angle of between 20 and 60 degrees, between 25 and 55 degrees, between 30 and 50 degrees, between 35 and 45 degrees, 40 degrees, or any specific angle within these ranges. The steep angle and short length of the channels 132 allow the cap to be secured to the bottle with less than a full 360 degree turn of the cap relative to the bottle. Each channel extends less than 360 degrees around the inside of the stem 130. For example, each channel may extend three quarters, two thirds, one half, one third, one quarter, or less, of the distance around the inside of the stem. When two channels are present, each channel may extend one half, one third, one quarter, or less, of the distance around the inner wall of the stem. When three channels are present, each channel may extend one third, one quarter, or less, of the distance around the inside of the stem. When four channels are present, each channel may extend one quarter or less of the distance around the inside of the stem. The channels may be angled so the protrusion travels the entire length of the channel, thereby securing the cap, with less than a quarter turn, a quarter turn, a third of a turn, a half turn, three quarters of a turn, etc.

The above configuration of channels also applies to the two part cap assembly shown in FIG. 3B. The cap 1110 is a single part that includes the features described above for the cap 110 and stem 130. The cap 1110 may have channels 1132 as discussed above disposed on an inner surface of the cap. The number, orientation, angle, overall structure, and spacing of the channels 1132 is as discussed above with reference to the three part cap shown in FIG. 3A.

Figure 5:
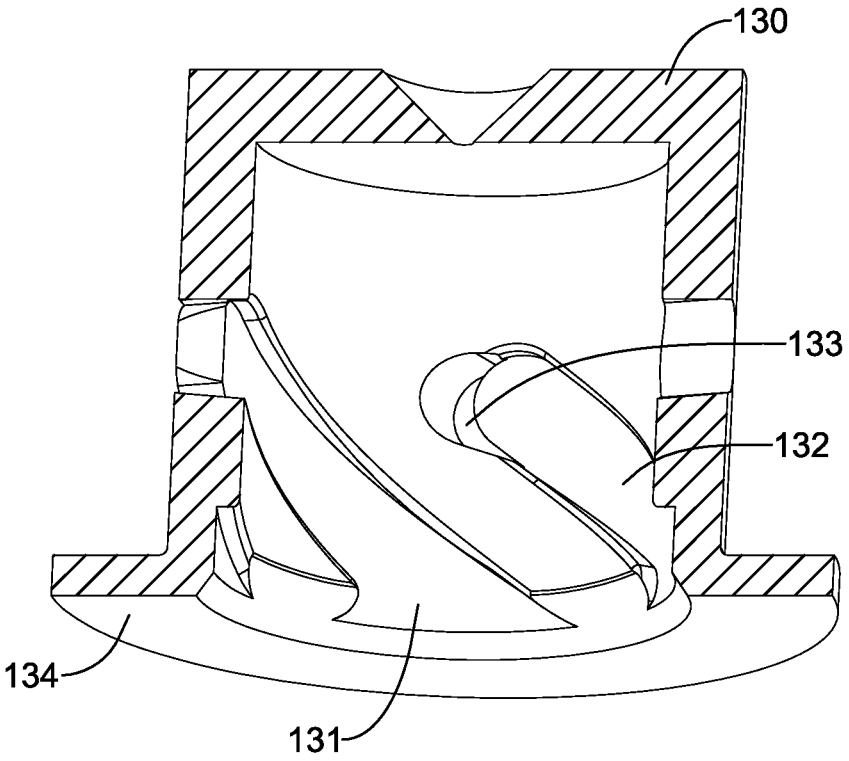
FIG. 5 is a perspective cross sectional view of a portion of the internal component of FIG. 4.

FIG. 5 shows a cross section of the stem with the elongate member 136 not shown to better illustrate the channel configuration. The proximal portion 133 of the channel extends at a more shallow angle compared to the main portion 137 of the channel. For example, the proximal portion 133 of the channel may extend at an angle of between 5 and 20 degrees, between 10 and 15 degrees, or any specific angle within these ranges. A bump or other suitable feature may be included in the proximal portion 133 to give a "clicking" sensation when the cap assembly is fully secured to the base assembly, and to give a clicking sensation when the user un-assembles the cap assembly from the base assembly.

The proximal portion 133 of the channel allows the cap to tighten onto the collar 170. The magnets 120 in the cap 110 and collar 170 facilitate proper and secure attachment of the cap 110 to the bottle 180 with little or no force applied by the user. As the user lowers the cap 110 onto the collar 170 with the protrusion 172 in the distal end 131 of the channel, the attractive force between the magnets 120 in the cap and the magnets 120 in the collar pulls the cap down toward the bottle 180, and the protrusion 172 travelling along the channel causes the cap to rotate. The transition in angle at the proximal portion of the channel encourages the cap to be tightened onto the bottle 180.

The strength of the attraction between the magnets 120 in the cap 110 and the magnets 120 on the bottle 180 are sufficient to overcome any viscous forces of the product in the bottle 180 acting on the elongate member 136 as the cap 110 is lowered onto the bottle 180 and the elongate member 136 is inserted into the product. The strength of the magnets may depend on the viscosity of the product, with stronger magnets used in containers for a viscous product such as lip gloss, for example, compared to a thinner product such as nail polish.

In order to replace the cap 110 on the bottle 180, the user positions the cap over the collar with the protrusions 172 in the distal end 131 of the channel 132. The user may release the cap, allowing the magnets to provide an attractive force that pulls the cap onto the bottle, as the protrusions 172 and channel 132 rotate the cap into a sealed configuration on the bottle. In this way, the container is self-closing. Alternatively, the user may apply additional rotational and/or downward force to aid the closure process.

The figures illustrate a container with protrusions on the collar and channels on the interior of the stem. This structure provides a container in which product spills on the collar may be easier to clean than conventionally threaded bottle collars, as the protrusions on the exterior of the collar may not collect as much product as threading. However, the reverse construction to that illustrated in the figures is contemplated. The channels may be provided in the outer surface of the collar and the protrusions may be provided on the inner surface of the stem. The operation of the container would remain the same and have the same advantages provided by the magnets and changing channel angle.

Each of these non-limiting examples can stand on its own, or can be combined in various permutations or combinations with one or more of the other examples. The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein. In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description.

The Abstract is provided to comply with 37 C.F.R. § 1.72(b), to allow the reader to quickly ascertain the nature of the technical disclosure. It is submitted with the understanding that it will not be used to interpret or limit the scope or meaning of the claims.

Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A container comprising:

a base assembly including a reservoir for holding a product, and a collar with an opening extending therethrough attached to the reservoir, the collar including a first magnet and at least one protrusion on an outer surface of the collar;

a cap assembly that is removably coupled to the base assembly, the cap assembly including a cap and a second magnet, wherein the cap includes at least one angled channel disposed along an inner surface thereof, the channel configured to receive the protrusion in sliding engagement; and wherein when the cap assembly is placed over the base assembly with the protrusion positioned in the channel, an attractive force between the first and second magnets pulls the cap assembly onto the base assembly, rotating the cap assembly into a secured position on the base assembly.

2. The container of claim 1, wherein the cap includes an outer cap and an inner cap disposed with the outer cap, wherein the at least one angled channel is disposed along an inner surface of the inner cap.

3. The container of claim 1, wherein each channel extends less than 360 degrees around the inner surface of the cap.

4. The container of claim 3, wherein each channel extends less than half of a circumference of the inner surface of the cap.

5. The container of claim 3, wherein each channel extends a quarter of a circumference of the inner surface of the cap.

6. The container of claim 1, wherein each channel has a main portion and a proximal portion, wherein an angle of the main portion relative to a transverse plane extending perpendicular to a longitudinal axis of the container, is greater than an angle of the proximal portion.

7. The container of claim 6, wherein each channel has a main portion and a proximal portion, wherein an angle of the main portion relative to a transverse plane extending perpendicular to a longitudinal axis of the container, is between 30 and 50 degrees.

8. The container of claim 7, wherein the angle of the main portion is 40 degrees.

9. The container of claim 7, wherein the angle of the proximal portion is between 10 and 15 degrees.

10. A container comprising:

a base assembly including a reservoir for holding a product, a collar with an opening extending therethrough attached to the reservoir, and at least one protrusion on an outer surface of the collar;

a cap that is removably coupled to the base assembly, the cap including at least one angled channel disposed along an inner surface thereof, the channel configured to receive the protrusion in sliding engagement, the channel extending less than 360 degrees around the inner surface of the cap, the channel having a main portion, wherein an angle of the main portion relative to a transverse plane extending perpendicular to a longitudinal axis of the container, is between 20 and 60 degrees; and wherein when the cap is placed over the base assembly with the protrusion positioned in the channel, the protrusion travels along the channel, guiding and rotating the cap into a secured position on the base assembly.

11. The container of claim 10, comprising four separate protrusions spaced equally apart around the collar, and four separate channels spaced equally apart around the inner surface of the cap.

12. The container of claim 11, wherein a proximal end of one channel overlaps an adjacent channel by no more than half.

13. The container of claim 10, wherein the channel extends a third or less of a circumference of the inner surface of the cap.

14. The container of claim 10, wherein the base assembly comprises a first magnet and the cap includes a second magnet.

15. A self-closing container comprising:

a base assembly including a reservoir for holding a product, and a collar with an opening extending therethrough attached to the reservoir, the collar including a first magnet and at least one protrusion on an outer surface of the collar;

a cap assembly that is removably coupled to the base assembly, the cap assembly including a cap and a second magnet, wherein the cap includes at least one angled channel disposed along an inner surface thereof, the channel configured to receive the protrusion in sliding engagement, wherein each channel has a main portion and a proximal portion, wherein an angle of the main portion relative to a transverse plane extending perpendicular to a longitudinal axis of the container, is greater than an angle of the proximal portion; and wherein when the cap assembly is placed over the base assembly with the protrusion positioned in the channel, the protrusion travels along the channel from the main portion to the proximal portion, thereby rotating the cap assembly as an attractive force between the first and second magnets pulls the cap assembly into a secured position on the base assembly.

16. The self-closing container of claim 15, wherein an angle of the main portion relative to a transverse plane extending perpendicular to a longitudinal axis of the container, is between 20 and 60 degrees, and the angle of the proximal portion of the channel is between 10 and 15 degrees.

17. The self-closing container of claim 15, wherein each channel extends a third or less of a circumference of the inner surface of the cap.

18. The self-closing container of claim 15, comprising four separate protrusions spaced equally apart around the collar, and four separate channels spaced equally apart around the inner surface of the cap.

19. The self-closing container of claim 16, wherein the cap assembly further comprises an applicator and the base assembly includes a wiper disposed within the opening in the collar.

20. The self-closing container of claim 15, wherein the cap includes an outer cap and an inner cap, wherein the at least one angled channel is disposed along an inner surface of the inner cap.

* * * * *